United States Patent [19]

Hess, Sr.

[11] Patent Number: 4,779,602

[45] Date of Patent: Oct. 25, 1988

[54] ARCHERY BOW SHOCK COMPENSATOR AND BALANCER

[76] Inventor: Robert E. Hess, Sr., 4554 E. Shields Ave., Fresno, Calif. 93726

[21] Appl. No.: 34,740

[22] Filed: Apr. 6, 1987

[51] Int. Cl.[4] ..... F41B 5/00

[52] U.S. Cl. ..... 124/89; 124/24 R; 267/136; 267/177

[58] Field of Search ..... 124/89, 88, 86, 23 R, 124/24 R, 45; 267/177, 175, 136, 137, 140.2

[56] References Cited

U.S. PATENT DOCUMENTS

| | | | |
|---|---|---|---|
| 3,589,350 | 6/1971 | Hoyt, Jr. | 124/89 X |
| 3,683,883 | 8/1972 | Izuta | 267/136 X |
| 4,245,612 | 1/1981 | Finlay | 124/89 |
| 4,478,204 | 10/1984 | Kocsan | 124/89 |
| 4,640,258 | 2/1987 | Penney et al. | 124/24 R |
| 4,660,538 | 4/1987 | Burgard | 124/89 |

FOREIGN PATENT DOCUMENTS

| | | | |
|---|---|---|---|
| 2538490 | 3/1977 | Fed. Rep. of Germany | 124/89 |
| 2520494 | 7/1983 | France | 124/86 |
| 386178 | 9/1973 | U.S.S.R. | 267/136 |
| 1296201 | 11/1972 | United Kingdom | 124/89 |

*Primary Examiner*—Randolph A. Reese
*Assistant Examiner*—Peter M. Cuomo
*Attorney, Agent, or Firm*—Melvin R. Stidham

[57] ABSTRACT

The abstract is of an archery bow compensator comprising a central rod or core that is threaded at its trailing end into a bow to extend forwardly therefrom. A chamber at the forward end of the rod may be loaded with pellets to balance the rod precisely in the archer's hand. An inertia sleeve carried on the rod moves forward when the bow string is released against the force of a compression spring. When compressed, the spring thrusts the sleeve back against a stop on the core to force the bow firmly into the Vee of the archer's hand against any tendency to jump out.

2 Claims, 1 Drawing Sheet

ARCHERY BOW SHOCK COMPENSATOR AND BALANCER

BACKGROUND OF THE INVENTION

There are available archery bow balancing devices that are secured to archery bows to extend forwardly therefrom. Such balancing devices generally comprise washers or rings that are added to or taken from a rod to balance the bow in the archer's hand. However, such washers are of such size and weight as to render it virtually impossible to balance the bow with any degree of precision.

I have found it extremely advantageous when shooting an archery bow, to hold the bow loosely in one hand, cradled in the Vee between the thumb and fingers, to minimize the torque or twist as the bow string is pulled back. In this way, even if the pull of the string is at a slight angle, the Vee of the archer's hand will function as a fulcrum to allow the bow to pivot and accommodate any twist on the bow string, thereby enabling the archer to achieve greater accuracy. However, with a conventional bow, such a loose grip is not feasible. The shock or recoil of the bow when the string is released causes the bow to jump from the hand and greatly and adversely affect the accuracy of the shot. Consequently, with a conventional archery bow, the archer must grip the bow firmly in his hand or wear some sort of support device to hold the bow.

Finlay U.S. Pat. No. 4,245,612 shows a stabilizer for an archery bow wherein a series of weights are placed on a rod, which is attached to the bow by a flexible coupling that absorbs the shock and vibration when the arrow is released. In Jeffrey U.S. Pat. No. 3,524,441 a weight is secured onto the end of a long rod which, in turn, is attached to the bow by a resilient coupling to absorb vibrations.

OBJECTS OF THE INVENTION

It is an object of this invention to provide an attachment for an archery bow which will balance the bow with precision in the archer's hand.

It is a further object of this invention to provide a shock absorber for an archery bow that will enable the archer to hold the bow loosely in the Vee between the thumb and fingers.

It is a further object of this invention to provide an archery bow that will produce little or no torque when the string is pulled and little or no lateral force vector of the string when released.

Other objects and advantages of this invention will become apparent from the description to follow, particularly when read in conjunction with the accompanying drawing.

SUMMARY OF THE INVENTION

In carrying out this invention, I provide a rod or central cylindrical core that may be threaded into the forward face of the bow to extend forwardly therefrom. A sleeve slidable on the core is biased toward the rear by a spring but tends to move forward by momentum as the bow string is released to absorb shock. After just an instant, the sleeve is snapped back under spring force against a resilient shock absorber. The resultant force is imparted to the bow into the Vee between the thumb and fingers so that it is easily held by the archer. A receptacle, which is carried on the end of the core or rod along which the sleeve slides may be loaded with just enough small lead pellets or shot to balance the bow precisely in the hand of the archer. A cap or plug closes the receptacle to hold the pellets in place. When the bow string is released, the outer sleeve moves forward by inertia or momentum to compress the shock absorbing spring between the pellet receptacle and an internal shoulder on the sleeve. The sleeve is then thrust back against a stop to drive the bow firmly into the Vee of the archer's hand. The lead weight receptacle may be threaded along the rod to adjust the compression of the spring, so that the reverse thrust will be in accordance with the effective force of the bow string.

DESCRIPTION OF A PREFERRED EMBODIMENT

Figure 2:
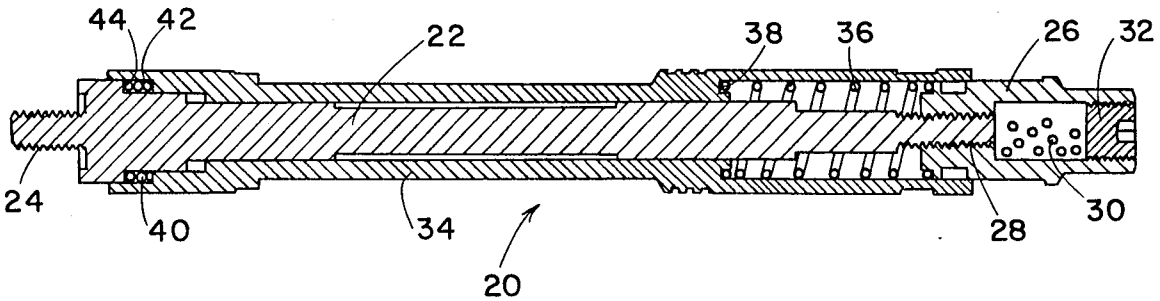
FIG. 2 is a section view of the shock absorber in normal position.

Referring now to the drawings with greater particularity, there is shown an archery bow 10, including a handle 12 and a string 14 stretched taut between top and bottom limbs 16 and 18. The balancer and shock absorber 20 of this invention is secured to the forward face of the bow 10 just below the handle 12 in a threaded socket conventionally provided in archery bows for attaching stabilizers and the like. Desirably, the bow 10 is held loosely in the Vee of the archer's hand H while the bow string 14 is being pulled back for shooting.

Figure 1:
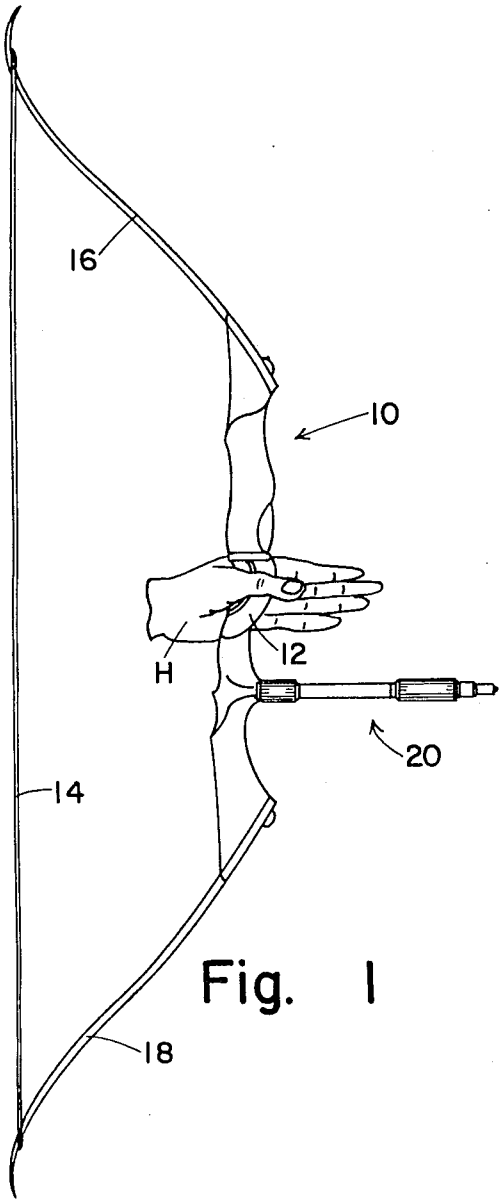
FIG. 1 is a side view of an archery bow on which is attached the shock compensator and balancer of this invention.

The balance-shock absorber 20 comprises a central core or rod 22 that has a threaded stem 24 at its trailing end. The threaded stem 24 is received into a threaded socket conventionally provided in the forward face of an archery bow 10 to secure the balancer-shock absorber 20 in place as shown in FIG. 1. A hollow receptacle or cup 26 is threaded onto the forward end 28 of the core or rod 22 to receive lead pellets or shot 30. When balancing, a threaded plug or cap 32 is removed from the cup 26 and the pellets 30 are poured in to precisely balance the rod in the archer's hand H so that there is no tendency for the bow to tilt from the vertical. In this way, a closer control over the trajectory of the arrow is maintained.

Figure 3:
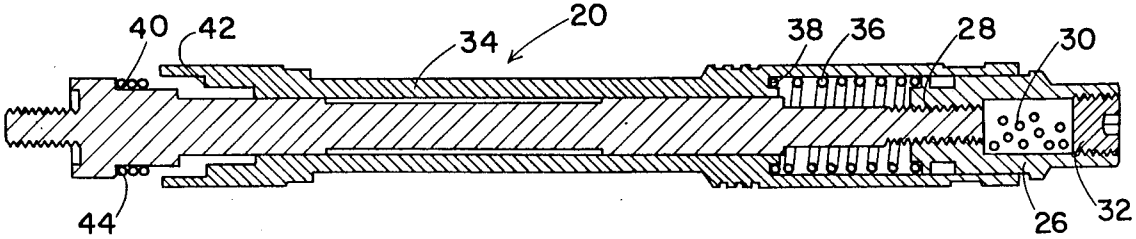
FIG. 3 is a section view of the shock absorber with the outer sleeve extended and the spring compressed.

A shock-absorber inertia sleeve 34 is slidably carried on the core 22 and is biased toward the rear by a strong spring 36 compressed between the pellet receptacle 26 and an internal shoulder 38 on the outer inertia sleeve 34. The pellet receptacle 26 is threaded onto the forward threaded extension 28 of the core, so that it may be turned to thread the receptacle in or out, to adjust the compression of the spring 36 in accordance with the pull of the bow string 14. When the outer inertia sleeve 34 moves forward and is then thrust back by the spring 36 from the position shown in FIG. 3 to that shown in FIG. 2, the impact is cushioned by resilient means, such as rubber O-rings 40.

In preparation for use, the receptacle plug 32 is removed and the receptacle 26 is loaded with enough pellets to balance the bow precisely in the hand H. In use, when the bow string is pulled back and an arrow shot, the inertia will tend to drive the outer sleeve 34 forward to the position shown in FIG. 3 wherein the spring 36 is compressed. Then, almost instantly, the spring 36 snaps the sleeve 34 back to the position shown in FIG. 2 with the impact between the internal shoulder 42 on the sleeve and the external shoulder 44 on the core 22 being cushioned by the resilient O-rings 40. This force tends to drive the bow firmly into the Vee between the thumb and fingers of the archer's hand H so that it is easily held.

While this invention has been described in conjunction with a preferred embodiment thereof, it is obvious that modifications and changes therein may be made by those skilled in the art to which it pertains, without departing from the spirit and scope of this invention, as defined by the claims appended hereto.

What is claimed as invention is:

1. A shock compensator for an archery bow comprising:

a rod adapted to be secured at one end to an archery bow to extend forwardly therefrom;

an inertia sleeve slidably carried on said rod;

an internal shoulder on said sleeve;

an external member on the other end of said rod;

a compression spring on said rod compressed between said internal shoulder and said external member to bias said sleeve rearward in a force to match the bow string force;

opposing shoulders on said sleeve and said rod to limit rearward movement of said sleeve on said rod;

resilient shock absorbing means between said opposing shoulders;

said external member being threaded onto said rod to enable precise setting of the compression of said spring and having a chamber therein;

a selected number of pellets in said chamber weighting said other end of said rod to balance said archery bow precisely; and a removable plug closing said chamber.

2. The shock compensator defined by claim 1 wherein said shock absorbing means comprises:

a selected number of resilient elastomer rings on said rod between said opposing shoulders.

* * * * *